United States Patent [19]

Imhof

[11] Patent Number: 5,005,724

[45] Date of Patent: Apr. 9, 1991

[54] FLOATING COVER FOR THE INTERIOR OF A STORAGE TANK

[75] Inventor: Heinrich L. Imhof, Offenbach, Fed. Rep. of Germany

[73] Assignee: Ingenieurbuero Imhof GmbH, Offenbach am Main, Fed. Rep. of Germany

[21] Appl. No.: 430,103

[22] Filed: Oct. 31, 1989

Related U.S. Application Data

[63] Continuation of Ser. No. 204,098, Jun. 8, 1988, abandoned.

[30] Foreign Application Priority Data

Jun. 19, 1987 [DE] Fed. Rep. of Germany ..... 3720302

[51] Int. Cl.[5] ..... B65D 88/42

[52] U.S. Cl. ..... 220/222; 220/216; 220/227

[58] Field of Search ..... 220/216, 221, 222, 224, 220/227

[56] References Cited

U.S. PATENT DOCUMENTS

| | | | |
|---|---|---|---|
| 2,023,308 | 12/1935 | Cantacuzene | 220/227 |
| 2,281,748 | 5/1942 | Carney | 220/227 |
| 2,664,220 | 12/1953 | Cord et al. | 220/227 |
| 2,867,347 | 1/1959 | Champagnat | 220/227 X |
| 2,873,042 | 2/1959 | Fino | 220/222 |
| 3,862,701 | 1/1975 | Strunc et al. | 220/227 |
| 3,980,199 | 9/1976 | Kays | 220/227 |
| 4,199,074 | 4/1980 | Gammell et al. | 220/218 |
| 4,276,991 | 7/1981 | Gunther | 220/222 X |
| 4,353,477 | 10/1982 | Bruening | 220/222 X |
| 4,438,863 | 3/1984 | Wilson et al. | 220/227 |
| 4,705,185 | 11/1987 | Barbillat | 220/222 |

FOREIGN PATENT DOCUMENTS

| | | |
|---|---|---|
| 607596 | 12/1934 | Fed. Rep. of Germany . |
| 632472 | 6/1936 | Fed. Rep. of Germany . |
| 893915 | 1/1953 | Fed. Rep. of Germany . |
| 735793 | 11/1932 | France . |

*Primary Examiner*—John Rivell

*Attorney, Agent, or Firm*—W. G. Fasse; D. H. Kane, Jr.

[57] ABSTRACT

An internal floating cover for covering and sealing the surface of a liquid stored in a tank having an external roof, has a flexible thin-walled membrane which floats on the surface of the liquid. The membrane is provided with at least one float and a seal around its perimeter edge or rim extending near and along the wall of the storage tank. The dimensions of the membrane are oversized relative to the corresponding liquid surface dimension of the tank and/or the membrane is made with a certain elasticity so that the membrane may bulge in a hood- or dome-shaped out of the plane of its contact with the inner tank surface. The movable connection between the membrane rim or edge includes clamping strips or contact elements on the floats or on a perimeter seal. The bulging of the membrane may occur upwardly under the effect of gas pressure or may occur downwardly under the effect of reduced pressure during draining of the liquid. At least one pressure relief valve is arranged in the membrane. At least one continuous ring-shaped perimeter edge or rim element is attached to the perimeter edge of the membrane in a gas-tight manner, near and along the storage tank wall. The edge or rim element is, at least partly, immersed in the liquid.

33 Claims, 3 Drawing Sheets

16
19a
19c
19d
19e
19b
h
H
6
2
19
34
19i
19j
19h
19g
19k
19f
28
10
9c
9a
9b
5
14
7
9
9d
23a
23
22
24
21
12a
18
11
12
13

Fig.3
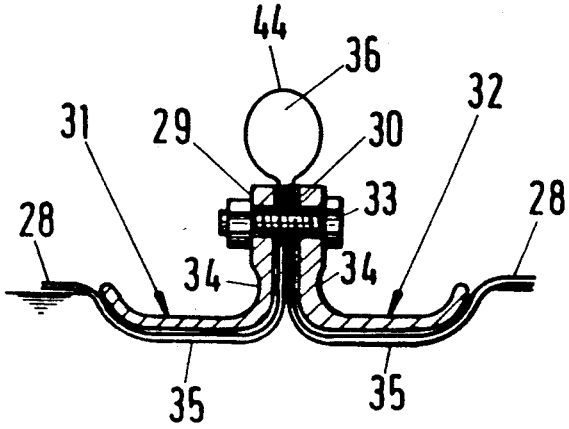
Fig.4
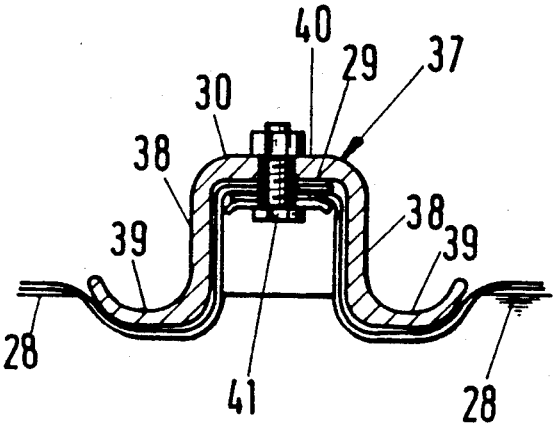
Fig.5
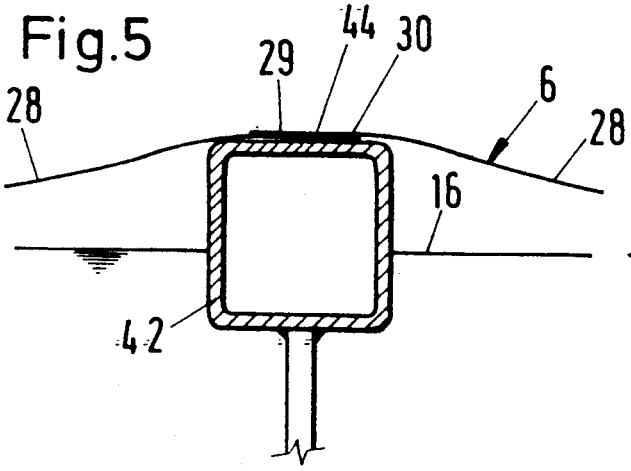
Fig.6
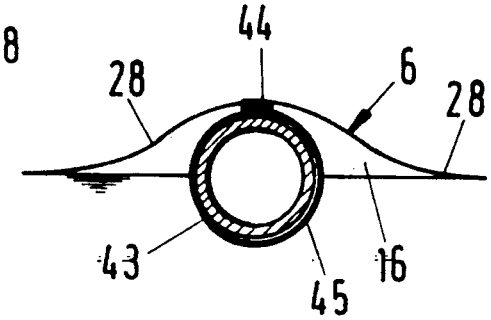
Fig.7
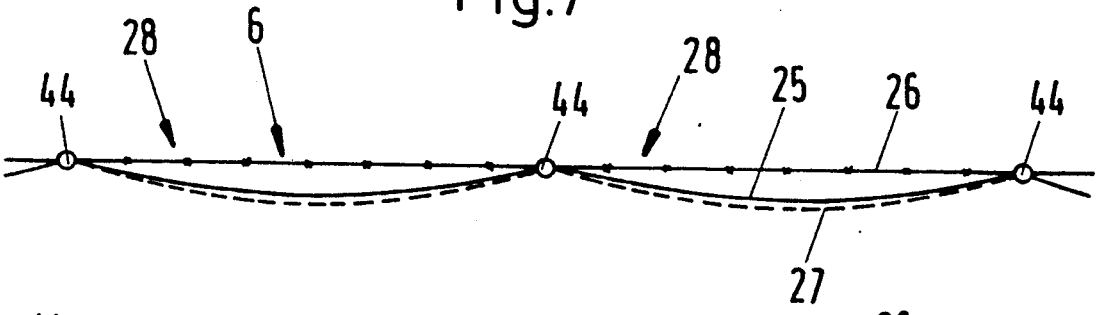
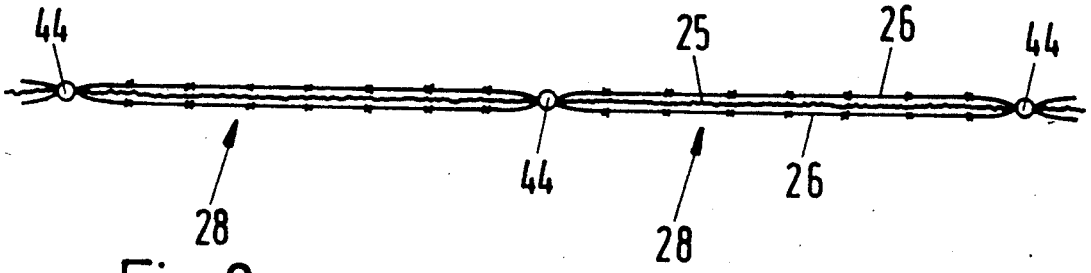
Fig.8

FLOATING COVER FOR THE INTERIOR OF A STORAGE TANK

This application is a continuation of application Ser. No. 204,098, filed 6/8/88, now abandoned.

FIELD OF THE INVENTION

The invention relates to an internal floating cover for covering and sealing the surface of a liquid stored in a tank which has a roof or external cover. Such an internal floating cover includes a flexible thin-walled membrane which floats on top of the liquid. The cover further includes at least one float, and a seal arranged around the perimeter edge of the membrane to contact the vertical walls of the storage tank.

DESCRIPTION OF THE PRIOR ART

Internal floating tank covers of the general type described above are known in the art. For example, German Patent Publication 632,472 discloses an internal floating cover for volatile liquids. The known cover includes a ring-shaped float and a plurality of spheres afloat on the liquid to form a seal between the float proper and the storage tank wall. The membrane of the known internal floating cover should be made of aluminum foil, cellular fabric material, thin yet strong or robust metal, celluloid, liquid-impermeable cloth or the like, whereby it may also further be reinforced or strengthened by a wire mesh.

Modern internal floating covers of the described type must meet a great variety of technical and other requirements. Thus, such covers are not only to be produceable at a reasonable price, but also are to be made of an extremely thin, lightweight, yet diffusion-impermeable membrane material. Nevertheless, the membrane must be able to securely cover and seal large planar surfaces of possibly chemically agressive liquids. For reasons of environmetal protection, it is further to be assured that gases or vapors are not allowed to escape to the atmosphere as free emissions, or at least that such emissions are held to an absolute minimum. Improvements over the prior art are to be made in these respects.

OBJECTS OF THE INVENTION

In view of the foregoing it is the aim of the invention to achieve the following objects singly or in combination:

to construct an improved internal floating cover of the general type described above which will securely and reliably withstand not only the mechanical and hydraulic loads applied to it by the medium being stored, but also the loads of any arising gas pressures;

to achieve an improved sealing effect in such an internal floating tank cover to minimize or eliminate the evaporation of volatile liquids and therewith the emission of gases or vapors;

to achieve a best possible utilization of as much of the entire volume of the storage tank for storing the liquid;

to achieve a simple construction of a floating cover for covering large surfaces of possibly chemically agressive liquids, with a thin-walled and light, yet diffusion-impermeable membrane, with an acceptably low cost and technical effort;

to construct the cover membrane of several different layers if need be, whereby each layer provides optimum physical or chemical characteristics; and to trap and seal-in any vapors or gaseous emissions from a body of liquid covered by the present floating cover.

SUMMARY OF THE INVENTION

The above objects have been achieved in a floating tank cover according to the invention, wherein the floating cover includes a membrane having dimensions which are oversized relative to the tank surface dimensions and/or having a certain elasticity, so that the membrane is deformable in a hood-shape or bubble-shape out of the plane in which it is attached to the float or perimeter seal. The bubble-shaped deformation can occur vertically upwardly when the membrane traps gases or vapors released from the stored liquid, or vertically downwardly as the tank is being emptied to allow removal of essentially all of the stored liquid. Furthermore, the vertical bubble-shaped deformation may either occur across one horizontal direction, thereby forming one or more essentially cylindrical shaped bubbles, or across both horizontal directions, thereby forming an essentially hemispherical-shaped bubble. At least one pressure relief valve is arranged to vent excessive pressure from under the membrane. At least one continuous ring-shaped perimeter edge element is connected in a gas-tight manner to the membrane near the storage tank wall. The perimeter edge element is at least partially immersed in the stored liquid.

The membrane of the present internal floating cover has a separating layer comprising one or several plies, whereby the length and width or the diameter of the membrane is considerably over-dimensioned relative to the corresponding dimensions of the liquid surface of the liquid stored in the tank in order to permit the above mentioned bubble formation or bulging in an upward or downward direction. In the event that gases or vapors are developed by and released from the stored liquid, the membrane billows or bulges upwardly over the liquid surface due to the developed gas pressure. At that time, the gases or vapors cannot escape to the atmosphere. Instead, the gases or vapors are held or retained by the membrane. Only after the gas pressure exceeds a predetermined value, a safety valve in the form of a pressure release valve arranged in the membrane opens, whereby excess gas pressure is vented off so that the membrane is not damaged. Until the opening pressure of the safety valve is reached, the membrane can be completely lifted away and bulge or billow above the surface of the liquid, whereby the membrane floats on a gas bubble. In order to prevent any leakage losses or escape of gas before the safety valve opens, the membrane itself, or the perimeter edge element which is connected in a gas-tight manner to the membrane, is immersed in the stored liquid around the membrane edge near the storage tank wall, whereby a sure sealing is achieved.

When the tank is being emptied, the membrane may bulge downwardly to eventually rest on the surface of the storage tank floor or any other equipment, such as pumping equipment, located on the tank floor. This downward bulging is also only possible because the membrane is over-dimensioned relative to the corresponding storage tank dimension. The downward bulging of the membrane during emptying of the tank achieves an optimum utilization of the entire volume of the storage tank. That is to say, the storage tank may be essentially completely emptied without taking any special emptying measures and without losing any volume to the structure of the floating cover.

The material of the membrane is respectively matched to or selected with regard to the properties of the stored liquid which is to be covered and the gases and vapors which are to be sealed-in, as well as with regard to the mechanical requirements. In order to achieve various optimum mechanical and chemical properties, the membrane may be made of a single ply or layer, or it may include several layers having various properties. In order to economically produce a large area membrane, it may be assembled of several separate sheets or webs which are attached to each other along their respective edges by seam welding or heat fusing, or by providing mechanical clamping elements.

BRIEF DESCRIPTION OF THE DRAWINGS

In order that the invention may be clearly understood, it will now be described, by way of example, with reference to the accompanying drawings, wherein:

FIG. 3 is a cross-sectional view through a connecting element for interconnecting separate webs to form the membrane;

FIG. 4 is a sectional view through an alternative connecting element for interconnecting separate webs to form the membrane;

FIG. 5 is a sectional view through a float for supporting the membrane;

FIG. 6 is a sectional view through an alternative float for supporting the membrane;

FIG. 7 is a sectional schematic view through an assembled membrane; and

FIG. 8 is a sectional schematic view through an alternative assembled membrane.

DETAILED DESCRIPTION OF PREFERRED EXAMPLE EMBODIMENTS AND OF THE BEST MODE OF THE INVENTION

Figure 1:
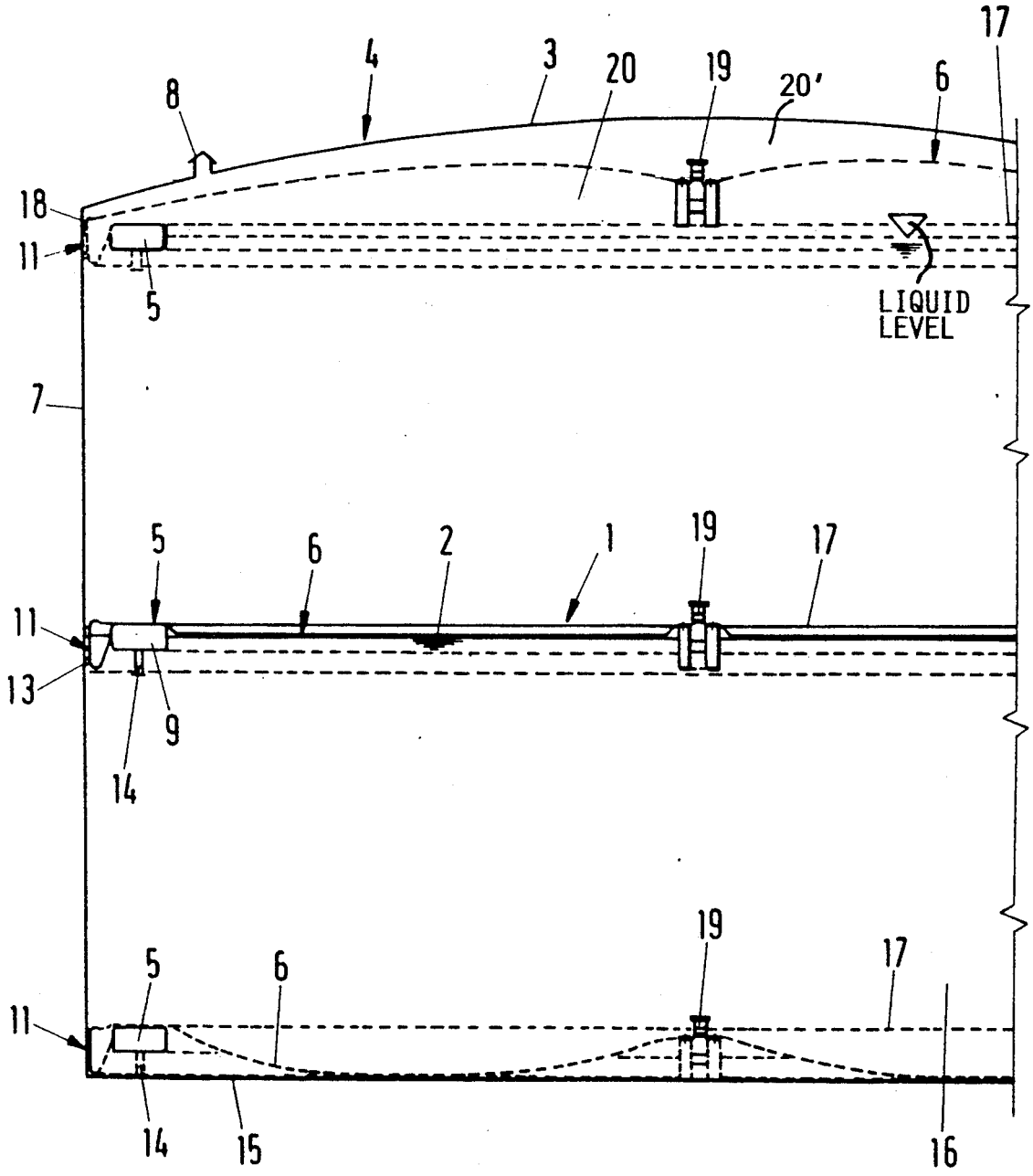
FIG. 1 is a partial schematic sectional view of a liquid storage tank with the inner floating cover according to the invention shown by solid lines at an intermediate liquid level and shown with dashed lines at a full level and at an empty level.

As shown in FIG. 1, an internal floating cover 1 covers and seals the surface 2 of a liquid 16 stored in a container or storage tank 4 having an external cover or roof 3 which is typically slightly arched or vaulted and usually has at least one ventilating stack 8 for venting the tank, or the space between the floating cover 1 and the roof 3, to the atmosphere. A tank wall 7 of the storage tank 4 defines the cross-sectional shape of the tank which may, for example, be circular. The tank 4 is closed at the bottom by a floor 15 which may include any necessary pumping equipment or outlets. The internal floating cover 1 at least comprises a float 5, a flexible thin-wall membrane 6 which usually floats on the surface 2 of the liquid 16, and a seal 11 which contacts the tank wall 7 around the perimeter edge of the membrane 6.

Figures 2, 2A:
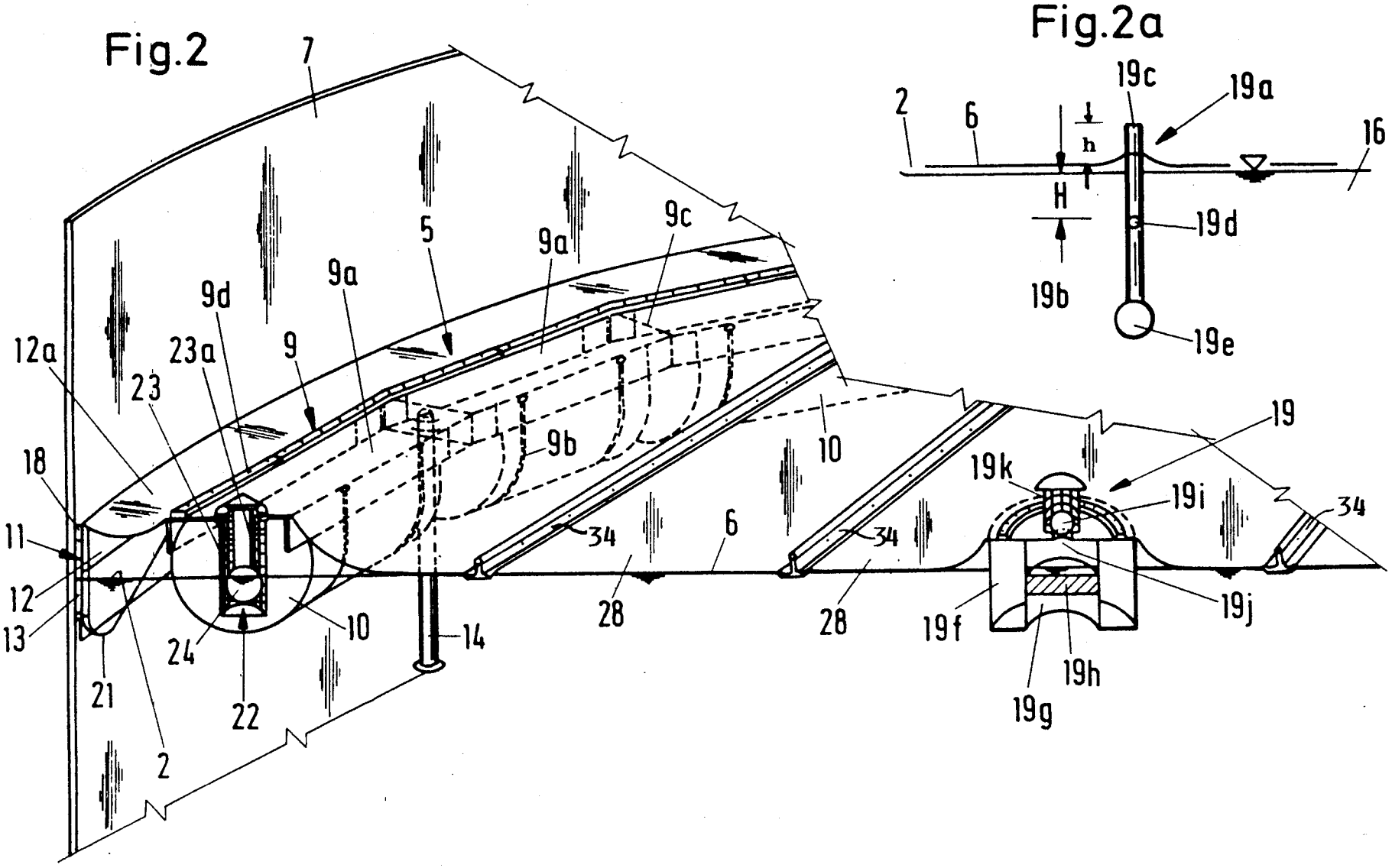
FIG. 2 is a partial sectioned perspective view of an enlarged detail of the floating cover in the perimeter area of its contact with the storage tank wall.
FIG. 2*a* is a schematic side view of an alternative pressure relief valve.

In the example embodiment shown in FIG. 1 and in the detail of FIG. 2, the float 5 comprises a frame 9 with several floating buoyant bodies 10 which are interconnected to form a ring-shaped polygon. Carrier sections 9*a*, which are each straight sections and have a U-shaped cross-section, are attached, for example by means of straps 9*b*, to the likewise straight drum-shaped floating bodies 10. Preferably, the ends of the bodies 10 are spaced a slight distance from each other. The carrier sections 9*a* abut one another at their facing ends 9*c* extending at an angle relative to each other. The carrier sections may be attached to each other at the respective ends 9*c*. The carrier sections 9*a* further comprise clamping rails 9*d* for attaching the membrane 6.

A seal 11 is provided along the storage tank wall 7. The seal 11 includes a sealing skirt 12*a* which bridges an annular gap 12 between the frame 9 and the tank wall 7, as well as a sealing element 13 which contacts the tank wall 7 as is shown in the detail view of FIG. 2.

Struts or feet 14 are provided on the bottom of the frame 9 to rest on the tank floor 15 when a minimum liquid level is reached as shown by dashed lines near the bottom of FIG. 1. The dimensions of the membrane 6 are oversized relative to the corresponding dimensions of the storage tank 4, and/or the membrane 6 has a certain elasticity sufficient so that the membrane 6 may bulge or arch out of the plane 17 of its attachment, for example, by means of clamping strips 9*d* to the floats 5, or rather to the frame 9, or alternatively, to a contact element 18 of the seal 11 along the tank wall 7. The membrane 6 may bulge or billow upwardly as shown at the top of FIG. 1, or may bulge or curve downwardly as shown at the bottom of FIG. 1, under different filling states of the tank 4.

At least one pressure relief valve 19 which is normally closed is arranged in the membrane 6. The valve 19 is activated, for example, when a sufficient volume 20 of gases is trapped between the membrane 6 and the surface 2 of the liquid 16 to develop an excessive pressure. The valve 19 is normally closed, so that normally an increased gas pressure caused by evaporation into the space between the membrane 6 and the liquid surface lifts the membrane 6 away from the surface 2 of the liquid 16, whereby the membrane 6 takes on an upwardly vaulted shape, depending on its dimensions and elasticity as shown at the top of FIG. 1. When the float 5, due to its feet 14, comes to rest above the tank floor 15 when the tank is empty, the membrane 6 bulges downwardly as shown at the bottom of FIG. 1. This up or down vaulted or bulging shape is advantageously predetermined so that the membrane 6 may still bulge upwardly, according to the dashed lines shown at the top of FIG. 1, without contacting the roof 3 of the storage tank 4 even when the tank is filled to the maximum permitted liquid level. The membrane 6 then bulges up with a hood shape or a hemispherical cap shape under the roof 3 before the pressure relief valve 19 is activated. The valve 19 is activated before any excessive pressure leads to damage of the membrane 6. Thus, the valve 19 prevents an excessive expansion of the membrane 6.

Advantageously, at least one pressure relief valve 19 is arranged at the center of the membrane 6. The valve 19 is lifted by the membrane 6 out of the liquid 16. The activation or opening pressure for the pressure relief valve 19 is, for example, advantageously on the order of the pressure exerted by a 1 to 2 mm column of water.

As shown in FIG. 2, a pressure relief valve 19 comprises a ringshaped float 19*f* having a coaxially or centrally arranged throughhole 19*g*. The float 19*f* preferably has a structural height equal to the maximum intended bulging height of the membrane 6. A droplet separator 19h is arranged in the through-hole 19g. A valve opening 19j at the end of the through-hole 19g above the drop separator 19h is closed by a valve ball 19i which is held in a cage 19k of the pressure relief valve 19. When a predetermined gas pressure is exceeded under the membrane 6, the valve ball 19i is lifted from the valve opening, 19j and excess gas escapes through the pressure relief valve 19 into a space 20' above the membrane 6 until the gas pressure is reduced sufficiently to allow the valve ball 19i to again close the valve opening 19j. This is achieved, for example, in that the membrane 6 lifts the valve 19 with its float 19f from the liquid 16 when the bulging of the membrane 6 exceeds a maximum allowable bulge. Then, excess gas can escape through the through-hole 19g into the space 20', until the bulge is diminished so that float 19f again contacts the liquid 16.

In an alternative embodiment as shown schematically in FIG. 2a, a pressure relief valve 19a comprises at least one hose-or pipe shaped element 19b which is immersed vertically in the liquid 16. The pipe 19b has one open end 19c located at a sufficient safety distance h above the surface 2 of the liquid 16. That is to say, the end 19c of the pipe element 19b opens a sufficient distance h above the membrane 6 to prevent any liquid 16 from being expelled through the opening 19c. At a spacing H, see FIG. 2a, below the surface 2 of the liquid 16, the pipe element 19b comprises at least one opening 19d. A weight 19e, or the like, assures that the pressure relief valve 19a or specifically, the pipe element 19b assumes a vertical hanging position in the normal operating state. When the membrane 6 is lifted by increasing gas pressure out of the position in which it is resting on the surface 2 of the liquid 16 as shown in FIG. 2a, into the bulging position shown by dashed lines at the top of FIG. 1, spacing H is reduced until it becomes zero and the opening 19d emerges above the surface 2 of the liquid 16.

Prior to the just mentioned rise of the valve pipe element 19b the liquid 16 effectively closed the opening 19d and the gas pressure or tank pressure was not sufficient to force liquid 16 into the pipe element 19b. However, after the opening 19d has been lifted above the surface 2 of the liquid 16, excess gas 20 is free to escape through the opening 19d into the pipe element 19b and finally exit from the open end 19c into the space 20'.

Thus, either pressure relief valve 19 or 19a is hydraulically activated or controlled. That is to say, it operates on the basis of its position relative to the surface 2 of the liquid 16. The hose or pipe element 19b penetrates essentially perpendicularly through the plane of the membrane 6 and is attached and sealed in a liquid and gas pressure-tight manner to the membrane 6. Such an attachment and sealing is also true for the components of the pressure relief valve 19.

The floating cover 1 according to the invention further includes at least one continuous ring-shaped perimeter edge element attached in a gas-tight manner to the perimeter edge of the membrane 6. The perimeter edge element extends close to and along the tank wall 7 and is at least partially immersed in the liquid 16. This perimeter edge element assures that the membrane 6 can form a billowed or bulged hood for confining a gas bubble without leaking or billowing upwards along the perimeter edge of the membrane 6. This perimeter edge element may be formed by the seal 11, or by the float 5, or by an immersed seal part 13 of the seal 11. The immersed or submerged seal member 13 may basically also be a part of the membrane 6 if the membrane 6 is made of a highly chemically resistive and heat-fusible material. In this manner the attachment by means of clamping strips 9d may be avoided if the membrane 6 also directly forms the seal skirt 12a as well as the immersed seal element 13. Usually, however, the membrane 6 is attached to the frame 9 in a gas-tight manner together with the separate seal skirt 12a of the seal 11. A surfacially heat-fused membrane 6, for example formed of separate membrane strips or webs joined together by heat-fusing as described below, can be extended to reach completely to the contact element 18 of the seal 11 only in the case of chemically highly resistive and heat-fusible or weldable membrane materials with resultant chemically resistive heat-fused seams.

Finally, the seal 11 includes several spring elements 21 which may, for example, be U-shaped and which connect the seal 11 with the floats 5 or the frame 9, and which additionally press the seal 11 outwardly for sealing against the tank wall 7.

At least one vacuum relief valve 22 is located in the frame 9. The vacuum relief valve 22 is activated when the struts or feet 14 of the frame 9 or floats 5 come to rest on the tank floor 15 during emptying of the tank 4 when any liquid remaining between the membrane 6 and the tank floor 15 is still to be pumped out. In this case, a slight vacuum is formed under the membrane 6, whereby the vacuum relief valve 22 opens, so that air streams from the space above the membrane 6 into the space between the tank floor 15 and the membrane 6. Thus, the remaining liquid may be pumped out as the membrane 6 progressively comes to rest on the tank floor 15 as is shown at the bottom of FIG. 1. As shown in the detail of FIG. 2, the vacuum relief valve 22 preferably comprises a vertically arranged valve basket 23 with a central pipe 23a and a valve ball 24 which is normally submerged in and buoyed by the liquid 16. After the feet 14 have come to rest on the tank floor 15 and the level of the liquid 16 continues to drop, the valve ball 24 drops downwardly along with the liquid level and thereby opens the valve opening of the central pipe 23a. In this manner, air enters the space under the membrane as described above.

The membrane 6 comprises at least one layer or ply which is tear and puncture resistant as well as impermeable to diffusion and also anti-static or resistant to accumulation of static electric charge. In view of the possible broad range of physical and chemical properties of the respective different liquids 16 to be covered, the requirements to be met by the membrane 6 can be widely variable. As the case may be, the membrane 6 at least comprises a metal film or a diffusion impermeable synthetic film which is provided on at least one side with a protective armor layer.

As shown particularly in FIG. 7, in order to cover and seal volatile hydrocarbons, the membrane 6 advantageously includes a special barrier film 25 which is durable and impermeable to diffusion by hydrocarbon vapors. Polyester, polyamide or polyvinyl alcohol is especially suitable as a material for such a barrier film 25. However, these films typically do not provide sufficient mechanical strength and are usually electro-statically chargeable. Therefore, in addition to a barrier film 25 made of polyester, polyamide or polyvinyl alcohol, the membrane 6 comprises a layer of fabric 26 as an anti-static puncture protective layer on top of the barrier film 25, and a further anti-static bottom layer 27 underneath the barrier film 25. Both the fabric layer 26 and the bottom layer 27 may comprise a reinforcing fabric or mesh with an anti-static thermoplastic coating, for example, a coating of polyethylene.

As further shown in FIG. 7, the separate layers or plies of the membrane 6, that is, the polyethylene coated fabric 26, the barrier film 25, and the anti-static bottom layer 27, lie loosely on top of one another. In other words, the various layers are not laminated or surfacially attached to one another. It is further provided that the length dimensions of the diffusion impermeable barrier film 25 are larger than the corresponding dimensions of the armor layer or polyethylene coated fabric layer 26. Thus, any arising tension forces in the multilayer membrane 6 are taken up in the armor fabric 26, with the result that the delicate barrier layer 25 and its bottom layer coating 27 remain free of undesirable loads or stress.

In another example embodiment of the membrane 6 according to FIG. 8, a fabric 26*a* serving as an armor layer is arranged above a barrier film 25, and a further fabric armor layer 26*b* is arranged below the barrier film 25. Similarly, as described above, in this embodiment the barrier film 25 lies relatively loosely between the two fabric layers 26*a* and 26*b* and is therefore not loaded by any arising forces. In fact, the load free condition of the barrier film 25 in this embodiment is independent of forces acting vertically upwardly or vertically downwardly. Thus, in this embodiment, the barrier film 25 remains unloaded when the membrane 6 is billowing upwardly due to a gas pressure developing under the membrane as well as when the membrane 6 is bulging downwardly due to draining of the liquid from the tank.

In view of the relatively large size of the surface 2 of the liquid 16 to be covered by the membrane 6 in storage tanks of a typical size, the membrane 6 is preferably assembled of separate sheets or webs 28 which are connected to each other along their edges 29, 30. Whenever possible, this connection along the edges 29, 30 is carried out by means of welding (heat-fusing) or gluing. However, when the material characteristics of the films, layers, or fabrics do not allow the seams to be heat-fused, or if the resulting bonded or fused seams are not sufficiently chemically resistant and liquid and gas-tight, then flexible clamping and holding sections are provided along the seams as connection members. When only some of the layers of the membrane 6 are sufficiently heat-fusible, adjacent webs 28 may be joined along edges 29, 30 by heat-fusing and by providing clamping members.

In the example embodiment shown in FIG. 3, two clamping and holding sections 31, 32 each having an L-shaped cross-section are provided as connecting elements. The lengthwise edges 29, 30 of adjacent sheets or webs 28 are bent or angled upwardly away from the liquid 16 and are received between the two-L-shaped clamping sections 31, 32. Bolts 33 tightly clamp the clamping and holding sections 31 and 32 together, with the web edges 29 and 30 clamped in between. Each clamping and holding section 31, 32 has one L-shank 34 contacting an edge 29, 30 of the web 28 and the other L-shank 35 resting on top of the web 28 essentially parallel to the plane of the membrane 6. In this clamping arrangement the edges 29, 30 of the membrane webs 28 are lifted away and out of the liquid 16 so that the web edges 29, 30, which may be more susceptible to chemical attack, are not directly exposed to the agressive liquid 16. Furthermore, the essentially horizontal L-shanks 35 of the clamping and holding sections 31, 32 are slightly curved or rounded at their outer edges so that the membrane web 28 is not exposed to any sharp edge or corner.

Whenever the edges 29, 30 of one or another layer of the membrane webs 28 may be heat-fused together, this may be carried out in addition to the connection provided by the clamping sections 31, 32. The layer or layers of the webs 28 which are fused together along their edges 29, 30 may, for example, form a tube-shaped or hose-shaped protruding bead 36. For example, when using a polyethylene coated fabric 26 as an upper cover or armor layer, the edges of this coated fabric 26 may be heat-fused together while forming a hose-shaped bead 36 as described above.

FIG. 4 shows another embodiment for connecting the edges of adjacent membrane webs 28 by means of a clamping and holding section 37 having an essentially U-shaped cross-section with essentially vertical shanks 38 and an essentially horizontal connecting web or U-stem 40. Slightly bent or bow-shaped supporting flanges 39 project essentially horizontally from the lower ends of the shanks 38. The edges 29, 30 of the separate layers of the membrane webs 28 overlap in the area of the upper web or stem 40 of the U-shaped clamping and holding section 37, and are clamped together by means of bolts 41 tightly clamping a clamping rail 40' against the U-stem 40. In this clamping arrangement with a U-shaped clamping and holding section 37, the overlapping edges 29, 30 of the membrane webs 28 are lifted out of the liquid in a manner similar to that described above with respect to FIG. 3.

According to FIGS. 5 or 6, floats 42 or 43 are arranged under the membrane 6 and at least partially lift the membrane 6 out of the liquid 16. Advantageously, such floats 42 or 43 are placed primarily near the regions of the interconnection seams 44 between adjacent membrane webs 28, so that the connection seams 44 are lifted out of the liquid 16 so that they are not subjected to the chemically attacking nature of the liquid 16. In order to fix or attach a float 43 in the area of a connecting seam 44, loop-shaped holding elements 45 may extend from the seam 44, or rather from the webs 28 to reach around and hold the float 43.

FIGS. 7 and 8 have been described in detail above, but it should be noted here that they additionally show adjacent membrane webs 28 interconnected along their edges at connecting seams 44.

Although the invention has been described with reference to specific example embodiments, it will be appreciated, that it is intended to cover all modifications and equivalents within the scope of the appended claims.

What I claim is:

1. A floating cover for covering and sealing a liquid surface in a tank having an external roof, a tank floor, and at least one side wall, said floating cover comprising (a) a gas tight membrane of flexible material, normally floating on said liquid surface in substantially direct contact with said liquid surface, peripheral float means connected to said membrane for keeping said membrane afloat within a circle defined by said peripheral float means, (c) said membrane being dimensioned for bulging vertically upwardly in response to a pressure build-up in a space between said membrane and said liquid surface, said membrane bulging downwardly when said tank is empty and said float means come to rest above said tank floor, (d) peripheral sealing means arranged in a gas-tight manner along a perimeter rim of said membrane for sealing said space between said membrane and said liquid surface, (e) and at least one normally fully closed excessive pressure relief valve for normally closing off said space between said membrane and said liquid surface and for venting excessive gas pressure from said space between said membrane and said liquid surface before said excessive pressure leads to damage of said membrane, whereby said flexible membrane in combination with said normally fully closed valve provides an extra expandable volume, the maximum expansion of which is limited by said valve, to minimize evaporation losses and to avoid an excessive expansion.

2. The floating cover of claim 1, wherein said peripheral sealing means are arranged in a gas-tight manner along a perimeter rim of said membrane for sealing a space between said liquid surface and said membrane, said peripheral means being immersed in the liquid in said tank along said tank side wall.

3. The floating cover of claim 1, wherein said immersed element comprises a seal (11).

4. The floating cover of claim 1, wherein said immersed element comprises a circularly closed ring float.

5. The floating cover of claim 1, wherein said immersed element (13) is part of said membrane.

6. The floating cover of claim 1, wherein said membrane has an oversized dimension.

7. The floating cover of claim 1, wherein said membrane is made of elastic material.

8. The floating cover of claim 1, wherein said peripheral float means comprise a plurality of essentially straight carrying members assembled to form a polygonal frame attached to said membrane, and a plurality of essentially straight floating buoyant bodies respectively attached to said carrying members.

9. The floating cover of claim 1, wherein said peripheral float means comprises support legs arranged to stand on said tank floor when said tank is empty, and wherein said bulging of said membrane allows said membrane to lie approximately flat on said tank floor when said support legs stand on said tank floor.

10. The floating cover of claim 1, wherein said membrane is attached to said peripheral float means in a gas-tight manner.

11. The floating cover of claim 1, wherein said peripheral sealing means comprise a contact element contacting said tank wall, wherein an annular gap is formed between said peripheral float means and said tank wall, and wherein said membrane extends to a perimeter edge element to cover said annular gap and said peripheral float means in a gas-tight manner.

12. The floating cover of claim 1, wherein said pressure relief valve penetrates through and is sealed to said membrane at essentially the center of said membrane, and wherein said pressure relief valve comprises means for controlling automatically said pressure relief valve in a hydraulical manner.

13. The floating cover of claim 1, wherein said pressure relief valve comprises a ring-shaped float member having a structural height equal to a maximum height of said bulging of said membrane in an upward direction above said liquid surface.

14. The floating cover of claim 1, further comprising at least one vacuum or reduced pressure relief valve.

15. The floating cover of claim 14, wherein said vacuum relief valve is arranged in said peripheral float means.

16. The floating cover of claim 1, wherein said membrane comprises at least one layer of a material which is tear resistant, puncture resistant, diffusion impermeable, and anti-static.

17. The floating cover of claim 16, wherein said at least one layer comprises at least one thin barrier film of one of a synthetic film and a metal foil.

18. The floating cover of claim 16, wherein said at least one layer comprises an armor layer including a fabric with an anti-static thermoplastic coating.

19. The floating cover of claim 17, wherein said barrier film is a hydrocarbon-resistant, diffusion-impermeable barrier film made of at least one of a polyester, polyamide, and polyvinyl alcohol.

20. The floating cover of claim 18, wherein said thermoplastic coating is a polyethylene coating.

21. The floating cover of claim 1, wherein said membrane comprises a plurality of layers which are not laminated together, but rather lie loosely one on top of another.

22. The floating cover of claim 21, wherein said plurality of layers comprises a diffusion impermeable barrier film layer and at least one armor layer, whereby the length dimensions of said barrier film layer are larger than corresponding length dimensions of said armor layer.

23. The floating cover of claim 1, wherein said membrane comprises a plurality of separate adjacent membrane webs each having free web edges, and interconnecting means for interconnecting said adjacent webs at least along respective neighboring free web edges.

24. The floating cover of claim 23, wherein said free web edges are not exposed to contact with said liquid.

25. The floating cover of claim 24, wherein said interconnecting means comprises at least one clamping and carrying section.

26. The floating cover of claim 25, wherein said clamping and carrying section is flexible.

27. The floating cover of claim 25, wherein said clamping and carrying section has an essentially L-shaped cross-section.

28. The floating cover of claim 25, wherein said clamping and carrying section has an essentially U-shaped cross-section.

29. The floating cover of claim 25, wherein said clamping and carrying section is arranged above a plane of said membrane.

30. The floating cover of claim 23, wherein said membrane comprises at least one layer which is weldable or heat-fusible, and said interconnecting means comprises a welded or heat-fused seam.

31. The floating cover of claim 30, wherein said membrane further comprises additional layers which are not weldable or heat-fusible and said heat-fused seam forms a tube-shaped bead overlapping said layers which are not heat-fusible.

32. The floating cover of claim 1, further comprising at least one secondary float arranged under said membrane.

33. The floating cover of claim 32, further comprising loop-shaped retaining members extending from said membrane means to hold said secondary float in position under said membrane means.

* * * * *

UNITED STATES PATENT AND TRADEMARK OFFICE

CERTIFICATE OF CORRECTION

PATENT NO. : 5,005,724

DATED : April 9, 1991

INVENTOR(S) : Heinrich L. Imhof

It is certified that error appears in the above-identified patent and that said Letters Patent is hereby corrected as shown below:

Title Page:

In [57] Abstract, line 11, replace "dome-shaped" by --dome-shape--;

In claim 1, column 8, line 59, delete "peripheral";

column 8, line 60, before "float" insert --(b) peripheral--.

Signed and Sealed this

Twenty-seventh Day of October, 1992

*Attest:*

DOUGLAS B. COMER

*Attesting Officer*

*Acting Commissioner of Patents and Trademarks*